US008090272B2

(12) United States Patent
Ishikawa

(10) Patent No.: US 8,090,272 B2
(45) Date of Patent: Jan. 3, 2012

(54) IMAGE FORMING APPARATUS FOR DETECTING DEVELOPER CARTRIDGE STATUS

(75) Inventor: Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 904 days.

(21) Appl. No.: 12/039,113

(22) Filed: Feb. 28, 2008

(65) Prior Publication Data

US 2008/0205928 A1 Aug. 28, 2008

(30) Foreign Application Priority Data

Feb. 28, 2007 (JP) ..... 2007-050723

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS

| | | | | |
|---|---|---|---|---|
| 2006/0193643 | A1* | 8/2006 | Takagi et al. | 399/12 |
| 2006/0193645 | A1 | 8/2006 | Kishi | |
| 2006/0193646 | A1 | 8/2006 | Suzuki et al. | |
| 2008/0205911 | A1* | 8/2008 | Ishikawa et al. | 399/12 |

FOREIGN PATENT DOCUMENTS

| | | |
|---|---|---|
| EP | 01696283 | 8/2006 |
| EP | 01696284 | 8/2006 |
| JP | 06-258910 | 9/1994 |
| JP | 2006-243071 | 9/2006 |
| JP | 2006-267994 | 10/2006 |

OTHER PUBLICATIONS

Extended Search Report off of EP 08 00 3592 dated Jul. 1, 2008.
Japanese Office Action dispatched Sep. 13, 2011 in Japanese Application No. 2007-050723 and English translation thereof.

* cited by examiner

*Primary Examiner* — David Gray
*Assistant Examiner* — Andrew Do
(74) *Attorney, Agent, or Firm* — Banner & Witcoff, Ltd

(57) ABSTRACT

An image forming apparatus according to one aspect comprises: a main unit; and a developer cartridge detachably attached to the main unit. The developing cartridge comprises: a rotation body having a rotational axis and rotatable in a rotation direction; and one rotational arm of a first rotational arm or two rotational arms of the first rotational arm and a second rotational arm which are rotatable around the rotational axis. The main unit comprises: a swingable detecting arm; an elastic member that urges the detecting arm toward a neutral position. When the developer cartridge is attached to the main unit, the first rotational arm contacts with the detecting arm to swing in a first swing direction from the neutral position. When the rotation body rotates by a predetermined rotation amount, the second rotational arm contacts with the detecting arm in a second direction from the neutral position.

15 Claims, 8 Drawing Sheets

IMAGE FORMING APPARATUS FOR DETECTING DEVELOPER CARTRIDGE STATUS

CROSS-REFERENCE TO RELATED APPLICATIONS

This application is based upon and claims the benefit of priority from Japanese Patent Application No. 2007-050723, filed on Feb. 28, 2007, the entire contents of which are incorporated herein by reference.

TECHNICAL FIELD

One aspect of the present invention relates to an image forming apparatus which can perform new-product detection and type detection of the developer cartridge.

BACKGROUND

Generally, in image forming apparatuses such as laser printers, developer cartridges containing toner are detachably attached to their apparatus bodies. For example, JP-A-2006-267994 discloses an image forming apparatus capable of determining whether the attached developer cartridge is a new product (new-product detection) and also determining type of the developer cartridge (type detection) (see JP-A-2006-267994).

Specifically, the image forming apparatus disclosed in JP-A-2006-267994 includes, in a main unit, a swingable arm-shaped actuator, a spring that urges the actuator to a neutral position, a sensor that detects a swing of the actuator, and a controller that carries out new-product detection and type detection based on signals from the sensor. In addition, the image forming apparatus includes, in the developer cartridge, one or two contact projections extending radially outside from a predetermined shaft portion and a sensing gear that rotates around the shaft portion integrally with the contact projection.

In this image forming apparatus, when the developer cartridge is attached to the main unit, the contact projection presses one end of the actuator to swing the actuator, and this swing is detected by the sensor. A signal detected by this sensor is sent to the controller as a first detection signal. The controller determines, if having received this first detection signal, that the developer cartridge is a new product.

Moreover, in this image forming apparatus, when, for example, a front cover is closed after the developer cartridge is attached, a warm-up operation (idle rotation operation) is executed by the controller. Here, the idle rotation operation means an operation to rotate an agitator in the cartridge in order to agitate the toner contained in the developer cartridge.

In such an idle rotation operation, a transmission force from a drive source provided in the main unit is transmitted to the agitator and the sensing gear on the developer cartridge side via a plurality of gears. Thereby, agitation of the toner by the agitator is started, and the contact projection is rotated to further press the end of the actuator and separates from the actuator at a predetermined position. Thereafter, the actuator is to return to the neutral position due to an urging force of the spring. At this time, when two contact projections exist, the second contact projection again presses the end of the actuator to swing the actuator, and this swing is detected by the sensor. A signal detected by this sensor is sent to the controller as a second detection signal.

When the controller receives the second detection signal, the controller determines that the developer cartridge has a type A (for example, a type where the maximum sheets to be printed are 6000). Meanwhile, when the controller does not receive the second detection signal, the controller determines that the developer cartridge has a type B (for example, a type where the maximum sheets to be printed are 3000) different from the type A.

However, in the above image forming apparatus, the type have been detected based on the number of times the contact projection contacts with the actuator. Therefore, in order to make the two contact projections contact with the actuator, it is necessary to increase the amount of rotation of the sensing gear. For this reason, the moving range of the contact projections is increased. In addition, for the necessity of providing other elements outside the moving range thus increased, the size of the developer cartridge cannot be reduced.

SUMMARY

One aspect of the invention has an object of the present invention to provide an image forming apparatus which can satisfactorily carry out new-product detection and type detection and can reduce the size of the developer cartridge.

According to an aspect of the invention, an image forming apparatus comprising: a main unit; and a developer cartridge detachably attached to the main unit, wherein the developing cartridge comprises: a rotation body having a rotational axis and rotatable in a rotation direction; and one rotational arm of a first rotational arm or two rotational arms of the first rotational arm and a second rotational arm which are rotatable around the rotational axis, and the main unit comprises: a driving unit configured to rotate the rotation body in the rotation direction; a detecting arm swingable from a neutral position toward a first swing direction and toward a second swing direction opposite to the first swing direction; an elastic member that urges the detecting arm toward a neutral position; a detecting unit configured to detect a swing of the detecting arm; and a determining unit configured to determine whether the developer cartridge is a new product according to the presence of a swing of the detecting arm detected by the detecting unit and determine type of the developer cartridge according to a number of swings detected by the detecting unit, wherein, when the developer cartridge is attached to the main unit, the first rotational arm contacts with the detecting arm to swing in the first swing direction from the neutral position, wherein, when the developer cartridge comprises the second rotational arm, and the rotation body rotates by a predetermined rotation amount, the second rotational arm contacts with the detecting arm, thereby the detecting arm swings in the second direction from the neutral position.

BRIEF DESCRIPTION OF THE DRAWINGS

FIGS. 7A to 7D are views for explaining operations of the rotation body and the like when a developer cartridge of a type, where the maximum sheets to be printed are 3000, is attached to the main casing, wherein FIG. 7A is an explanatory view showing a state before the attachment, FIG. 7B is an explanatory view showing a state immediately after the attachment, FIG. 7C is an explanatory view showing an operation during an idle rotation operation, and FIG. 7D is an explanatory view showing a state where the rotation body has been irreversibly rotated; and FIGS. 8A to 8D are views for explaining operations of the rotation body and the like when a developer cartridge of a type, where the maximum sheets to be printed are 6000, is attached to the main casing, wherein FIG. 8A is an explanatory view showing a state before the attachment, FIG. 8B is an explanatory view showing a state immediately after the attachment, FIG. 8C is an explanatory view showing an operation during an idle rotation operation, and FIG. 8D is an explanatory view showing a state where the rotation body has been irreversibly rotated.

DESCRIPTION

Figure 1:
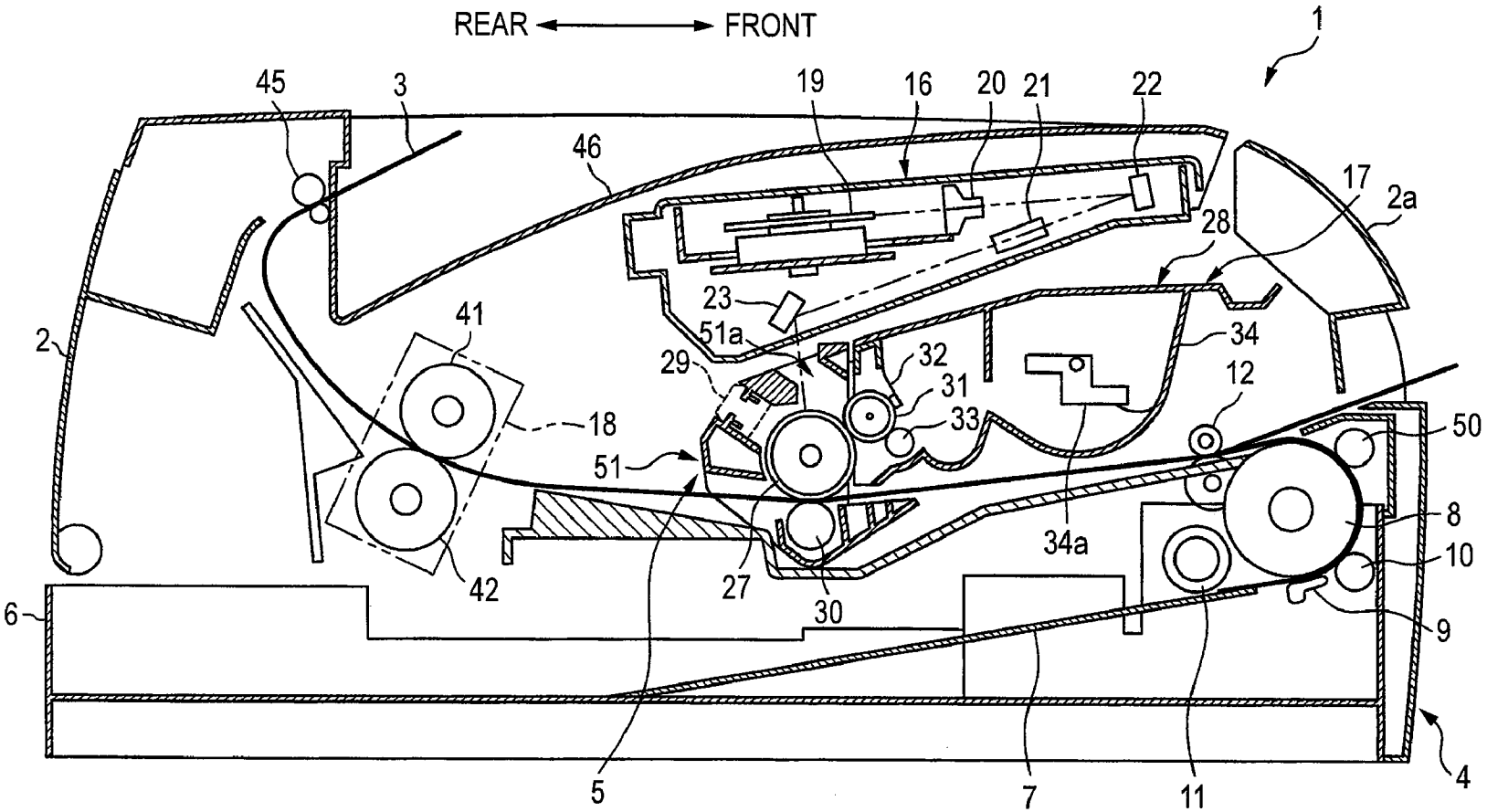
FIG. 1 is a side cross-sectional view showing a laser printer according to an embodiment of the present invention.

Next, an embodiment of the present invention will be described in detail with appropriate reference to the drawings. Of the drawings to be referred to, FIG. 1 is a side cross-sectional view showing a laser printer according to an embodiment of the present invention. Also, in the following description, the entire configuration of a laser printer will be briefly described at first, and then the details of the configuration will be described. In the following description, descriptions will be given in directions with reference to a user when using a laser printer 1. That is, in FIG. 1, the right side is referred to as "a front side," the left side is referred to as "a rear side," a back side in the direction vertical to the sheet surface is referred to as "a right side," and a near side in the direction vertical to the sheet surface is referred to as "a left side." Also, in terms of the up-and-down direction, since the illustrated direction is coincident with a direction when a user uses the laser printer, this is referred to as "an up-and-down direction" as it is.

<Entire Configuration of Laser Printer>

As shown in FIG. 1, the laser printer 1 provided as an image forming apparatus mainly includes a feeder unit 4 for feeding a sheet 3 into a main casing 2 provided as a main unit, and an image forming unit 5 for forming an image on the fed sheet 3.

<Configuration of Feeder Unit>

The feeder unit 4 includes a sheet feeding tray 6 that is detachably attached to a bottom portion in the main casing 2 and a sheet pressing plate 7 provided in the sheet feeding tray 6. In addition, the feeder unit 4 includes a send-out roller 11 provided above a one side end portion of the sheet feeding tray 6 and a feed roller 8, a feed pad 9, a pinch roller 10, and a paper dust removing roller 50 provided at a downstream side in the conveying direction of the sheet 3 with respect to this send-out roller 11. Further, the feeder unit 4 includes a registration roller 12 provided at a downstream side with respect to the paper dust removing roller 50.

In the feeder unit 4 thus configured, the sheets 3 in the sheet feeding tray 6 are brought close to the send-out roller 11 side by the sheet pressing plate 7, and sent out by the send-out roller 11 between the feed roller 8 and the feed pad 9. In addition, the sheets 3 are sent out one by one by the feed roller B and the feed pad 9 to pass through the various rollers 10, 50, and 12, and then conveyed to the image forming unit 5.

<Configuration of Image Forming Unit>

The image forming unit 5 mainly includes a scanner unit 16, a process cartridge 17, and a fixing unit 18.

<Configuration of Scanner Unit>

The scanner unit 16 is provided at an upper portion in the main casing 2 and mainly includes a laser light emitting unit (not shown), a polygon mirror 19 that is driven to rotate, lenses 20 and 21, and reflecting mirrors 22 and 23. A laser beam emitted from the laser light emitting unit and based on image data is, as shown by dot-dash lines, passed through or reflected on the polygon mirror 19, the lens 20, the reflecting mirror 22, the lens 21, and the reflecting mirror 23 in this order, and is irradiated onto the surface of a photosensitive drum 27 of the process cartridge 17 by high-speed scanning.

<Configuration of Process Cartridge>

The process cartridge 17 is detachably attached to the main casing 2 by appropriately opening a front cover 2*a* provided at the front side of the main casing 2. This process cartridge 17 mainly includes a developer cartridge 28 and a drum unit 51.

The developer cartridge 28 is detachably attached to the main casing 2 via the drum unit 51, more specifically, detachably attached to the drum unit 51 fixed to the main casing 2. Also, the attachment of this developer cartridge 28 to the main casing 2 may be carried out with the developer cartridge 28 alone, or may be carried out with the process cartridge 17 for which the drum unit 51 is attached to the developer cartridge 28.

The developer cartridge 28 mainly includes a developing roller 31, a layer thickness restricting blade 32, a supply roller 33, and a toner hopper 34. A toner in the toner hopper 34 is supplied to the developing roller 31 by the supply roller 33 after being agitated by an agitator 34a, and is, at this time, frictionally charged positively between the supply roller 33 and the developing roller 31. The toner supplied onto the developing roller 31 enters between the layer thickness restricting blade 32 and the developing roller 31 with a rotation of the developing roller 31 and is supported on the developing roller 31 as a thin layer with a fixed thickness. Also, details of the developer cartridge 28 will be described later.

The drum unit 51 mainly includes the photosensitive drum 27, a scorotron charger 29, and a transfer roller 30.

The photosensitive drum 27 is rotatably supported on a case of the drum unit 51. For this photosensitive drum 27, a drum body is grounded, and its surface part is formed of a positively charged photosensitive layer. Above this photosensitive drum 27, disposed is an exposure window 51*a* formed in a hole shape on the case of the drum unit 51.

The scorotron charger 29 is arranged obliquely above the photosensitive drum 27 (more specifically, at the rear side and the upper side of the photosensitive drum 27) at a distance of a predetermined interval so as not to contact with the photosensitive drum 27. This scorotron charger 29 is a scorotron charger for positive charging that produces a corona discharge from a charging wire made of tungsten or the like, and is configured so as to uniformly charge the surface of the photosensitive drum 27 with a positive polarity.

The transfer roller 30 is arranged, below the photosensitive drum 27, so as to be opposed to and contact with this photosensitive drum 27, and is rotatably supported on the case of the drum unit 51. This transfer roller 30 is formed by covering a metallic roller shaft with a conductive rubber material. This transfer roller 30 is applied with a transfer bias by constant current control at the time of transfer.

The surface of the photosensitive drum 27 is uniformly positively charged by the scorotron charger 29, and is then exposed with light by high-speed scanning of a laser beam from the scanner unit 16. Thereby, an exposed part is lowered in potential to form an electrostatic latent image based on image data. Here, the "electrostatic latent image" denotes, of the surface of the photosensitive drum 27 uniformly positively charged, the exposed part lowered in potential by being exposed with a laser beam. Subsequently, by a rotation of the developing roller 31, the toner supported on the developing roller 31 is supplied to the electrostatic latent image formed on the surface of the photosensitive drum 27 when the developing roller 31 is opposed to and contacts with the photosensitive drum 27. Then, the toner is formed into a visible image by being selectively supported on the surface of the photosensitive drum 27, whereby a toner image is formed by reversal development.

Thereafter, the photosensitive drum 27 and the transfer roller 30 are driven to rotate so as to convey the sheet 3 while sandwiching the same therebetween, and as a result of the sheet 3 being conveyed between the photosensitive drum 27 and the transfer roller 30, the toner image supported on the surface of the photosensitive drum 27 is transferred onto the sheet 3.

<Configuration of Fixing Unit>

The fixing unit 18 is disposed at a downstream side of the process cartridge 17, and includes a heating roller 41 and a pressing roller 42 that is arranged in a manner opposed to the heating roller 41 and presses the heating roller 41. In the fixing unit 18 thus configured, the toner transferred onto the sheet 3 is thermally fixed during the time the sheet 3 passes between the heating roller 41 and the pressing roller 42. Moreover, the sheet 3 thermally fixed by the fixing portion 18 is conveyed to a discharge roller 45 disposed at a downstream side of the fixing portion 18, and is sent out from this sheet discharging roller 45 onto a sheet discharging tray 46.

<Detailed Structures of Developer Cartridge and Inside of Main Casing>

Next, description will be given of detailed structures of the developer cartridge 28 and the inside of the main casing 2 to be characteristic parts of the present invention with reference to FIGS. 2 to 6B.

<Detailed Structure of Developer Cartridge>

Figure 2:
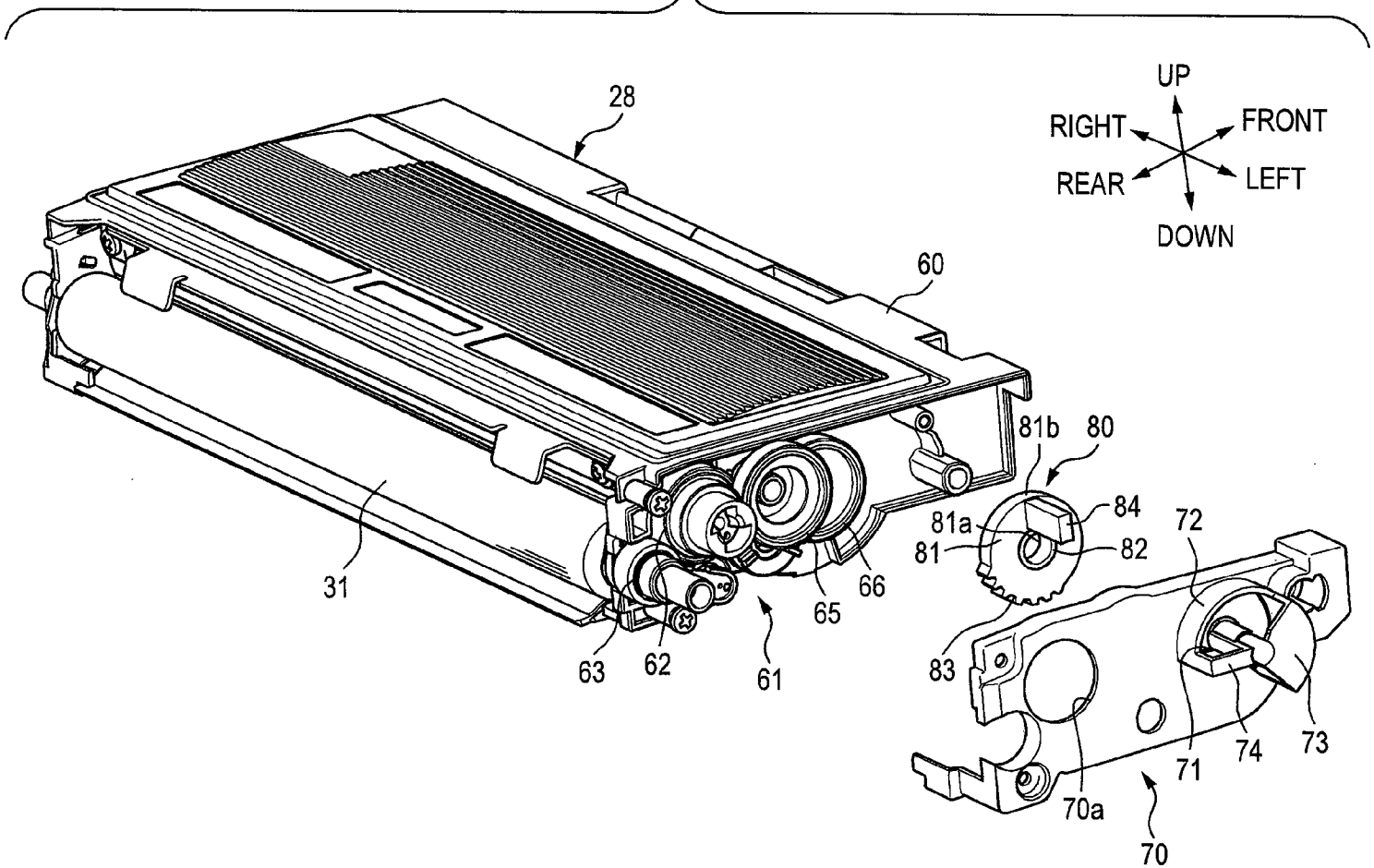
FIG. 2 is a perspective view showing a developer cartridge of a type where the maximum sheets to be printed are 3000.

As shown in FIG. 2, the developer cartridge 28 is formed not only with the developing roller 31 and the like but also with a cartridge body 60 and a cover body 70 detachably mounted to a left side surface of the cartridge body 60. Between the cartridge body 60 and the cover body 70, provided is a gear mechanism 61 for transmitting a driving force to the developing roller 31 and a rotation body 80 that is irreversibly rotatable in one direction.

Figure 3:
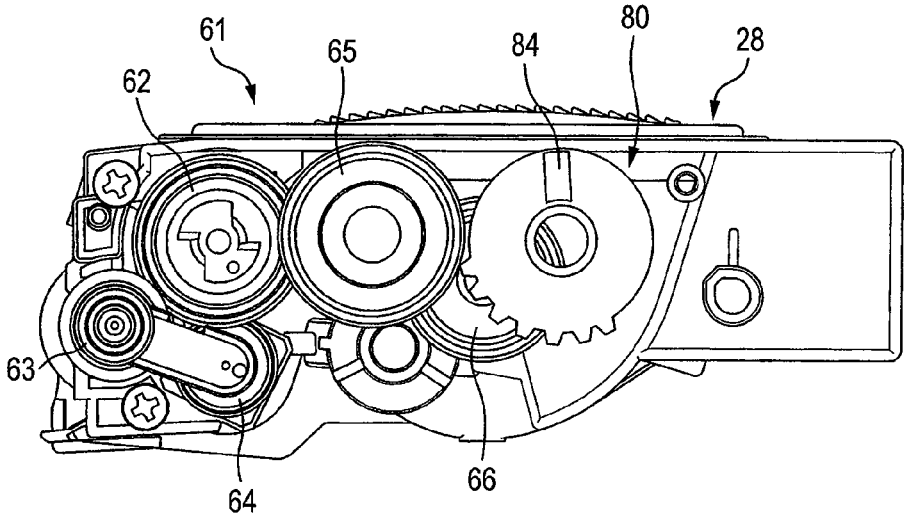
FIG. 3 is a side view of the developer cartridge of FIG. 2.

The gear mechanism 61 is, as shown in FIG. 3, formed with an input gear 62 transmitted with a driving force from a driving device 90 (see FIG. 5) provided on the main casing 2 side, a developing roller driving gear 63 and a supply roller driving gear 64 directly meshed with this input gear 62, and an agitator driving gear 66 meshed with the input gear 62 via an intermediate gear 65. Here, the developing roller driving gear 63, the supply roller driving gear 64, and the agitator driving gear 66 are gears to drive the developing roller 31, the supply roller 33, and the agitator 34a shown in FIG. 1, respectively, and are integrally provided at the end portions of respective axes of the developing roller 31, the supply roller 33, and the agitator 34*a*.

Figure 4:
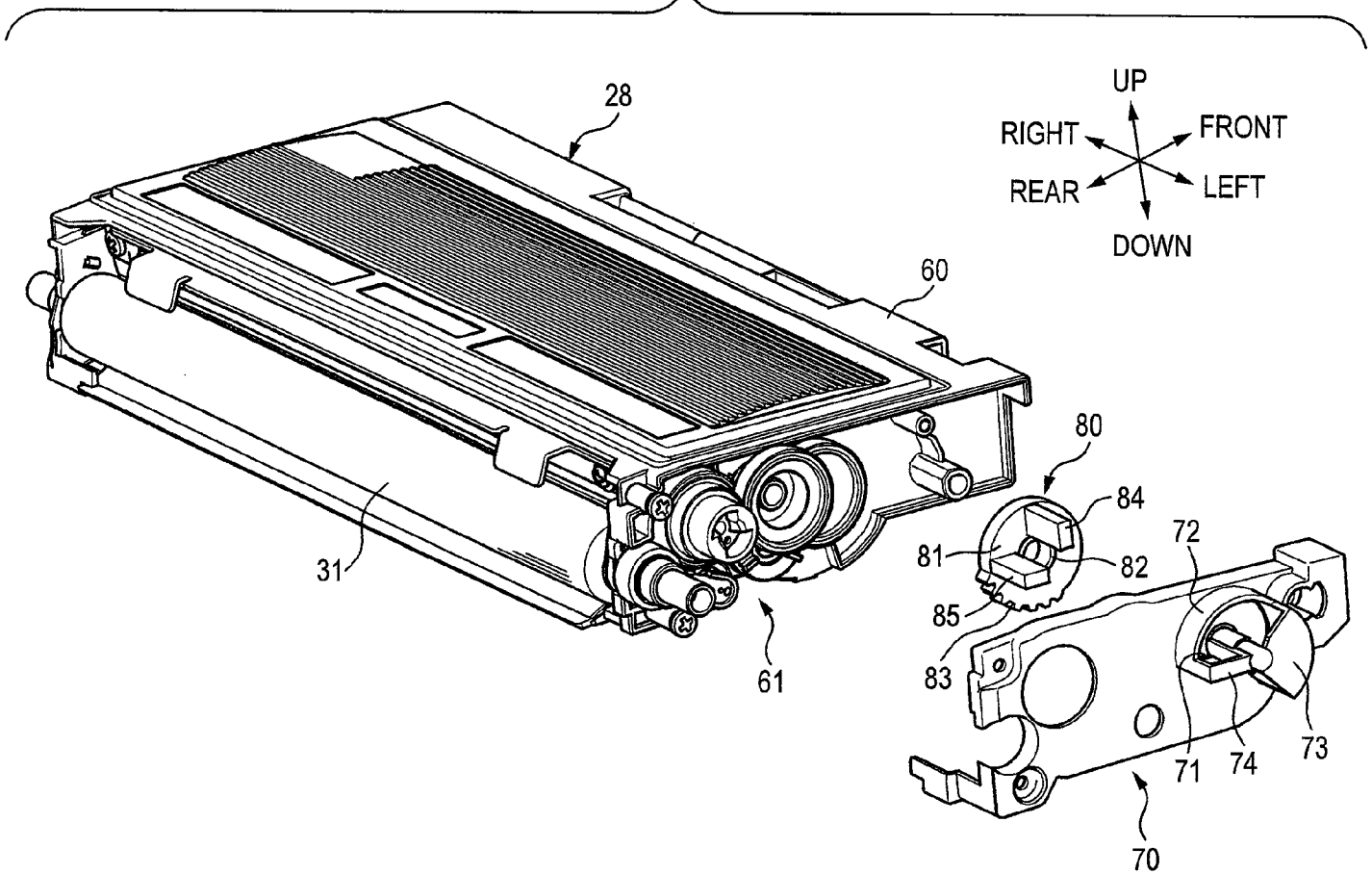
FIG. 4 is a perspective view showing a developer cartridge of a type where the maximum sheets to be printed are 6000.

As shown in FIG. 2, the rotation body 80 includes a disk 81 formed with a circular hole 81a at the center, a circular cylindrical shaft portion 82 as a rotational axis formed in a condition standing leftward from the circumference of the hole 81*a* of the disk 81, and a gear tooth portion 83 formed at a part of the outer circumferential surface of the disk 81. At a position in a left surface of the disk 81 (a position deviated from a rotational axis of the rotation body 80), formed is a rotational arm 84 extending along the rotational axis of the rotation body 80 and protruding from the surface of the cover body 70. Here, the number of the rotational arms 84 is set according to the type of the developer cartridge 28. In the present embodiment, the developer cartridge 28 of a type where the maximum sheets to be printed are 3000 is provided with, as shown in FIG. 2, only one rotational arm 84, and the developer cartridge 28 of a type where the maximum sheets to be printed are 6000 is provided with, as shown in FIG. 4, two rotational arms 84 and 85. That is, the developer cartridge 28 of a type where the maximum sheets to be printed are 6000 is provided with, in addition to the rotational arm 84 of the rotation body 80 used in the type of 3000 images, the second rotational arm 85 deviated by almost 90° to the rear side from the rotational arm 84. Also, in the following description, for the sake of convenience, the rotational arm 84 used for both types is referred to as "a first rotational arm 84," and the rotational arm 85 used only for the type of 6000 images is referred to as "a second rotational arm 85."

In addition, the rotation body 80 has, at a part other than the gear tooth portion 83 of its outer circumferential surface, a toothless portion 81*b* having no gear teeth, and is structured so as to rotate with the intermediate gear 65 when the gear tooth portion 83 meshes with the intermediate gear 65 and so as to be restrained when the gear tooth portion 83 separates from the intermediate gear 65. In other words, the gear tooth portion 83 is formed in the range of a part of a pitch circle that rotationally contacts with the intermediate gear 65, and this makes the rotation body 80 irreversibly rotatable in one direction. Also, the rotating direction of the rotation body 80 in the present embodiment is clockwise in a view from the left surface of the developer cartridge 28.

The cover body 70 is used in common with both types irrespective of the type of the developer cartridge 28. In the following description, for the sake of convenience, description will be given of the cover body 70 used for the type of 6000 images as a representative.

As shown in FIG. 4, in the cover body 70, mainly formed is an arc-shaped long groove 71 through which the first rotational arm 84 and the second rotational arm 85 of the rotation body 80 are inserted, a groove peripheral wall 72 protruding from the periphery of the long groove 71 toward the left side (outside), and an opening portion 70*a* that exposes the input gear 62 outward. At a most front part of the groove peripheral wall 72, formed is a protective wall 73 that encloses the respective rotational arms 84 and 85 from three directions of the rear, front, and left sides. Thereby, when the first rotational arm 84 is located at a front end of the long groove 71, the protective wall 73 prevents an external force from acting on the respective rotational arms 84 and 85 from the three directions of the rear, front, and left sides. Also, this protective wall 73 is, in order to protect the respective rotational arms 84 and 85 arranged in a manner deviated by almost 90°, formed in an approximately quarter fan shape in a view from the left side surface. In addition, at a rearmost part of the groove peripheral wall 72, formed is a protective wall 74 that encloses the second rotational arm 85 from the three rear, front, and left sides. Thereby, when the second rotational arm 85 is located at a rear end of the long groove 71, the protective wall 74 prevents an external force from acting on the second rotational arm 85 from the three rear, front, and left sides.

In addition, the groove peripheral wall 72 other than the protective walls 73 and 74 is formed so as to be lower than the front end of the first rotational arm 84. Thereby, when the developer cartridge 28 is attached to the main casing 2 while the first rotational arm 84 is arranged at an initial position (a predetermined position between the protective walls 73 and 74), the first rotational arm 84 contacts at that attaching position with a part of the main casing 2 in the front and rear direction. Here, "a part of the main casing 2" also includes elements of a device mounted on the main casing 2, and denotes, in the present embodiment, a detecting arm 93 of a new-product/type detecting device 91 to be described later (see FIG. 5).

<Detailed Structure of Inside of Main Casing>

Figure 5:
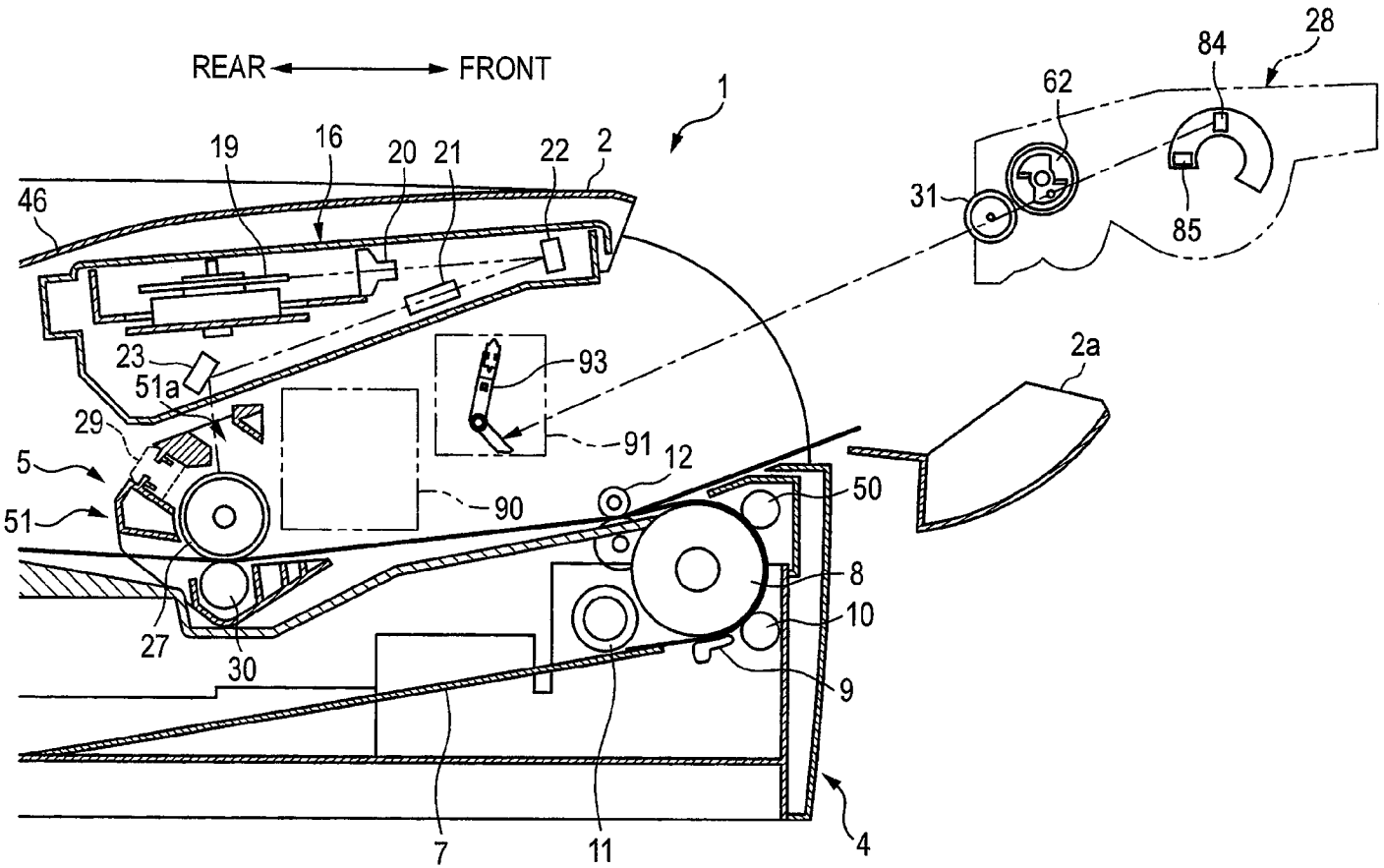
FIG. 5 is a cross-sectional view showing a state where the developer cartridge has been removed from a main casing.

As shown in FIG. 5, at a part where the developer cartridge 28 is attached in the main casing 2, provided is the driving device 90 that transmits a driving force to the input gear 62 of the developer cartridge 28 and the new-product/type detecting device 91 that detects whether the developer cartridge 28 is a new product and type of the developer cartridge 28.

The driving device 90 includes an unillustrated plurality of gears and drive motor. As a result of a gear on the driving device 90 side meshing with the input gear 62 when the developer cartridge 28 is attached to the inside of the main casing 2, a driving force from the drive motor is transmitted to the input gear 62 via the respective gears. In the driving device 90, the gear to mesh with the input gear 62 is structured so as to advance and retract with respect to the developer cartridge 28 in conjunction with opening and closing of the front cover 2*a*, for example. In this case, the gear to mesh with the input gear 62, when the front cover 2*a* is closed, advances toward the developer cartridge 28 and meshes with the input gear 62, and when the front cover 2*a* is opened, retracts from the developer cartridge 28, and the meshing with the input gear 62 is released.

Figure 6:
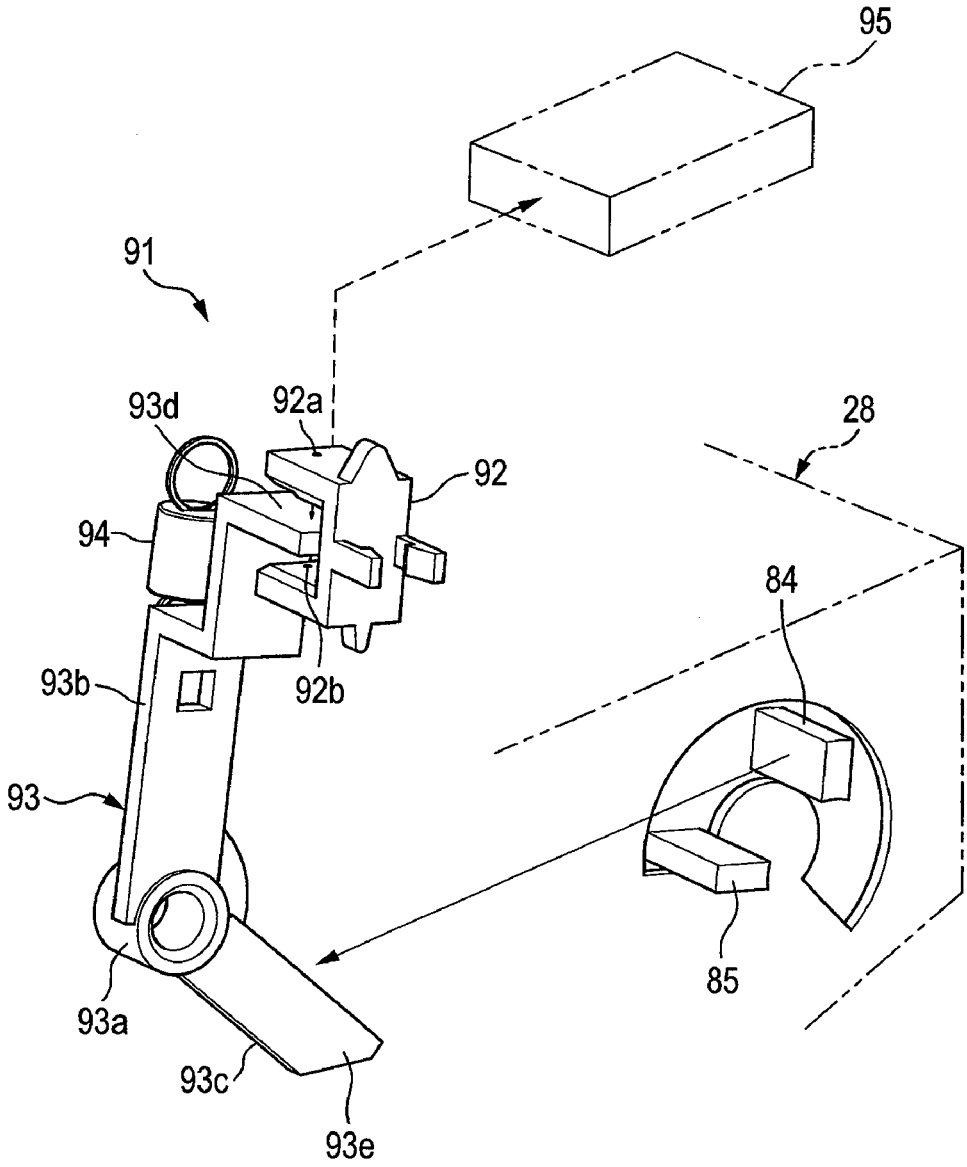
FIG. 6 is a perspective view showing respective elements of a new-product/type detecting device.

The new-product/type detecting device 91 is, as shown in FIG. 6, formed mainly with an optical sensor 92 provided as a detecting unit, a detecting arm 93, a coil spring 94 provided as an elastic member, and a controller 95 provided as a determining unit.

The optical sensor 92 is a sensor that detects a swing of the detecting arm 93, and includes a light emitting unit 92*a* that emits light and a light receiving unit 92*b* that receives light emitted from the light emitting unit 92*a*. This optical sensor 92 outputs a predetermined signal to the controller 95 when having received light from the light emitting unit 92*a* by the light receiving unit 92*b*.

The detecting arm 93 includes a cylindrical portion 93*a* rotatably attached to an unillustrated shaft portion provided on the main casing 2 and a light blocking arm 93*b* and a contacting arm 93*c* extending radially outside from the cylindrical portion 93*a*, and is formed so as to be swingable around the cylindrical portion 93*a*. In addition, the coil spring 94 is mounted at an appropriate place of the light blocking arm 93*b* of the detecting arm 93, whereby the detecting arm 93 is always urged to a neutral position by the coil spring 94. As a result, the detecting arm 93 is swingable from the neutral position in a first swing direction (clockwise direction in FIG. 6) and in a second swing direction opposite to the first swing direction (counterclockwise direction in FIG. 6). At this neutral position, a front end portion (one portion away from the swinging center) 93*d* of the light blocking arm 93*b* is arranged between the light emitting unit 92*a* and the light receiving unit 92*b*. Moreover, at the neutral position, a front end portion (the other portion away from the swinging center) 93*e* of the contacting arm 93*c* is arranged at a position where contact with the first rotational arm 84 of the developer cartridge 28 attached to the main casing 2 is possible (an opposing position).

The controller 95 has a function to determine whether the developer cartridge 28 is a new product according to the presence of a swing of the detecting arm 93 detected by the optical sensor 92 and determine type of the developer cartridge 28 according to the number of swings detected by the optical sensor 92. Concretely, this controller 95 executes a known idle rotation operation based on a closing signal from a sensor that senses a closing operation of the front cover 2*a* or a signal generated when the laser printer 1 is powered on. This controller 95 determines, when not having received any signal from the optical sensor 92 in a time between the start and end of the idle rotation operation, that the developer cartridge 28 is an old product. In addition, when the controller 95 has received a signal from the optical sensor 92 only once within the time, it is determined that the developer cartridge 28 is a new product and is of a type where the maximum sheets to be printed are 3000. Furthermore, when the controller 95 has received a signal from the optical sensor 92 twice within the time, it is determined that the developer cartridge 28 is a new product and is of a type where the maximum sheets to be printed are 6000. However, since the process (control method) for a new-product determination and a type determination is known (see JP-A-2006-267994, for example), detailed description thereof will be omitted.

Next, description will be given of operations of the rotation body 80 and the detecting arm 93 when two types of developer cartridges 28 are attached to the main casing 2 with reference to FIGS. 7A to 7D and 8A to 8D. New developer cartridges are shown in both of FIGS. 7A to 7D and 8A to 8D, respectively.

<Type Where the Maximum Sheets to be Printed are 3000>

First, description will be given of operations when the developer cartridge 28 of a type where the maximum sheets to be printed are 3000 is attached to the main casing 2.

Figure 7A:
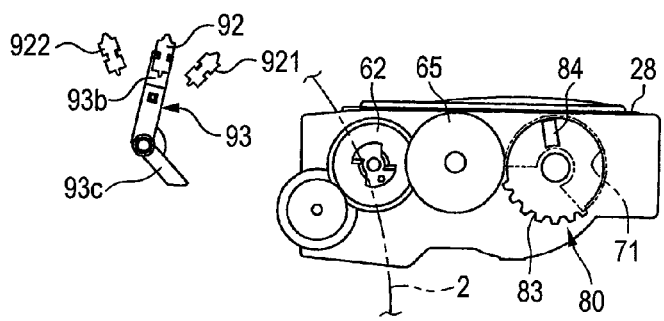

As shown in FIG. 7A, before the developer cartridge 28 is attached to the main casing 2, the first rotational arm 84 is located at almost the center of the long groove 71 (the rotation body 80 is positioned at a first rotation position), and at this position, the gear tooth portion 83 is arranged at a position separated from the intermediate gear 65.

Figure 7B:
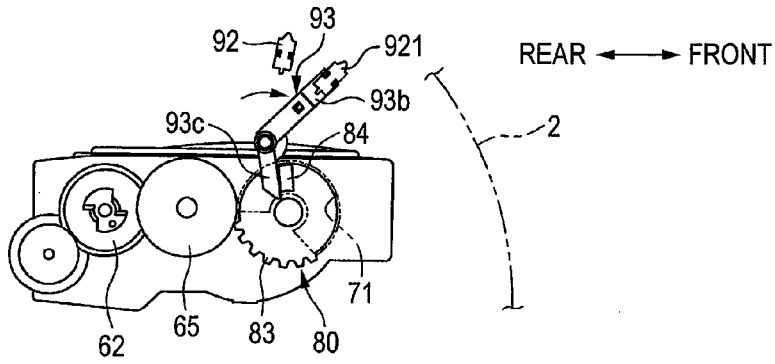

Then, as shown in FIG. 7B, when the developer cartridge 28 is inserted up to a predetermined mounting position in the main casing 2, the first rotational arm 84 contacts with the contacting arm 93*c* of the detecting arm 93. At this time, the first rotational arm 84 contacts with the contacting arm 93*c* of the detecting arm 93 always urged to the neutral position by the coil spring 94 and its movement is restrained, and the first rotational arm 84 thus relatively moves to the front side by a predetermined amount with respect to the developer cartridge 28 that is moving to the mounting position (the rotation body 80 moves to a fourth rotation position). Thereby, the rotation body 80 is rotated clockwise by a predetermined amount, and the gear tooth portion 83 of the rotation body 80 is pressed against the intermediate gear 65 and meshes therewith.

Then, when the gear tooth portion 83 and the intermediate gear 65 mesh with each other, the intermediate gear 65 restrains the rotation body 80 from rotation, and the first rotational arm 84 again moves with the developer cartridge 28 to press the contacting arm 93*c* to the rear side against an urging force of the coil spring 94. Thereby, the light blocking arm 93*b* of the detecting arm 93 is swung to the front side, light from the light emitting unit 92*a* is received by the light receiving unit 92*b*, and the optical sensor 92 is turned on to output a predetermined ON signal to the controller 95.

Figure 7C:
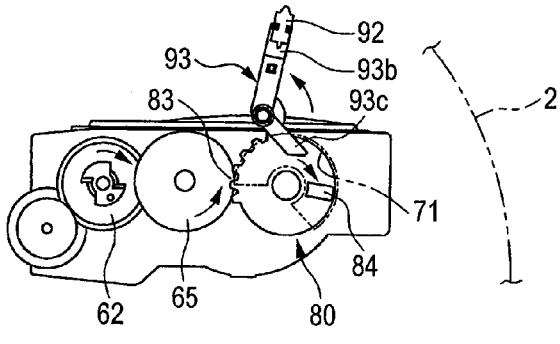

Thereafter, the controller 95 executes an idle rotation operation based on, for example, a signal indicating a closing operation of the front cover 2*a*. Also, at the start of this idle rotation operation, the controller 95 has been continuously receiving the ON signal, Then, when the controller 95 starts the idle rotation operation, as shown in FIG. 7C, a driving force of the driving device 90 is transmitted to the gear tooth portion 83 via the input gear 62 and the intermediate gear 65, and the rotation body 80 is rotated clockwise (direction where the first rotational arm 84 retracts from the detecting arm 93). That is, the rotational body 80 begins to rotate substantially at a time of beginning of a drive of the laser printer 1. Then, when the rotation body 80 rotates as such, the first rotational arm 84 moves to the front side, and the detecting arm 93 returns to the neutral position by the urging force of the coil spring 94 (the rotation body 80 is moves to a second rotation position). Thereby, the light blocking arm 93*b* of the detecting arm 93 returns to the original position to block light from the light emitting unit 92*a*, and the optical sensor 92 is turned off to stop transmission of the ON signal to the controller 95.

Figure 7D:
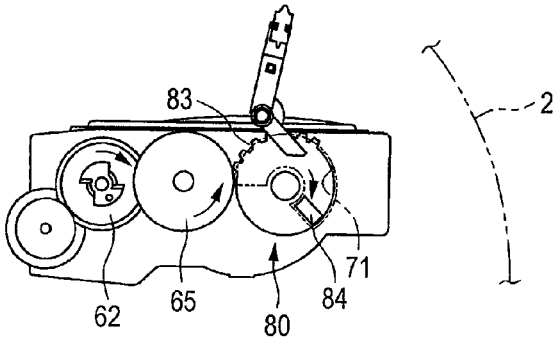

Thereafter, when the rotation body 80 further rotates and, as shown in FIG. 7D, the first rotational arm 84 is located at a most front end of the long groove 71, the gear tooth portion 83 separates from the intermediate gear 65 and the rotation body 80 is restrained from rotation (the rotation body 80 moves to the third rotation position). The gear portion 84 and the intermediate gear 65 may be separated from each other at any position between the fourth rotation position and the third rotation position. That is, the rotation body 80 rotates irreversibly around equal to or less than 360 degrees in one direction. Then, after ending the idle rotation operation, the controller 95 determines that the developer cartridge 28 is a new product and is of a type where the maximum sheets to be printed are 3000 based on the single signal (ON signal from the optical sensor 92) received during the idle rotation operation.

<Type Where the Maximum Sheets to be Printed are 6000>

Next, description will be given of operations when the developer cartridge 28 of a type where the maximum sheets to be printed are 6000 is attached to the main casing 2. Also, in the following description, description of the same structures and operations (such as a meshing state between the gear tooth portion 83 and the intermediate gear 65) as those of the type of 3000 images mentioned above will be appropriately omitted.

Figure 8A:
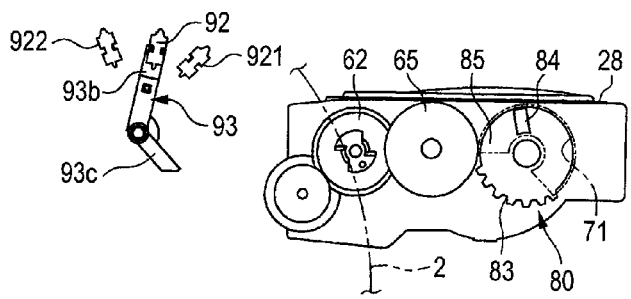

As shown in FIG. 8A, before the developer cartridge 28 is attached to the main casing 2, the first rotational arm 84 is located at almost the center of the long groove 71, and the second rotational arm 85 is located at the rear end of the long groove 71 (the rotation body 80 is positioned at a first rotation position).

Figure 8B:
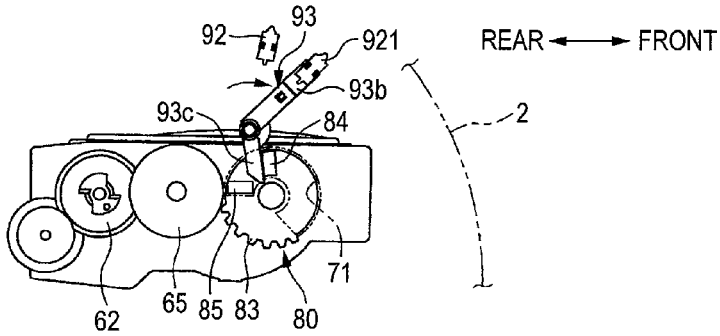

As shown in FIG. 8B, when the developer cartridge 28 is inserted up to a predetermined mounting position in the main casing 2, the first rotational arm 84 contacts with the contacting arm 93*c* of the detecting arm 93 from the front side. Then, when the developer cartridge 28 is inserted further (and the rotation body 80 moves to a fourth rotation position), by the first rotational arm 84 of the rotation body 80 locked by meshing between the gear teeth portion 83 and the intermediate gear 65, the contacting arm 93*c* of the detecting arm 93 is swung to the rear side, and this swing is detected by the optical sensor 92. At this time, the optical sensor 92 sends a first ON signal to the controller 95.

Figure 8C:
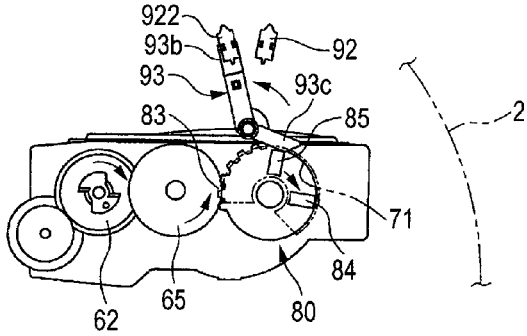
Figure 8D:
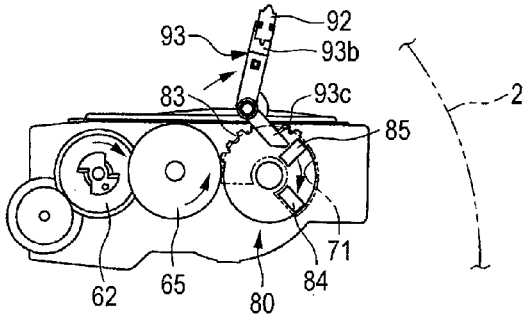

Thereafter, the controller 95 executes the same idle rotation operation as in the above. When the controller 95 executes an idle rotation operation as such, as shown in FIG. 8C, the rotation body 80 rotates clockwise, and the second rotational arm 85 moves to the front side along the long groove 71. The second rotational arm 85 moving as such (and the rotation body 80 positioned between a second rotation position and a third position) contacts with the contacting arm 93*c* of the detecting arm 93 from the rear side to swing this contacting arm 93*c* to the front side. Thereby, the light blocking arm 93*b* of the detecting arm 93 is swung to the rear side, and the optical sensor 92 is turned on, so that a second ON signal is sent to the controller 95. Thereafter, as shown in FIG. 8D, the rotation body 80 irreversibly rotates (the rotation body 80 positioned at the third position), and the detecting arm 93 returns to the neutral position. Then, after ending the idle rotation operation, the controller 95 determines that the developer cartridge 28 is a new product and is of a type where the maximum sheets to be printed are 6000 based on the two signals (the number of swings of the detecting arm 93) received during the idle rotation operation.

According to the above, the following effects can be obtained in the present embodiment.

By appropriately providing the first rotational arm 84 and the second rotational arm 85, new-product detection and type detection can be satisfactorily carried out. Further, since the amount of rotation of the rotation body 80 can be reduced by differentiating the direction in which the detecting arm 93 is pressed between the first rotational arm 84 and the second rotational arm 85, the size of the developer cartridge 28 can be reduced.

The gear tooth portion 83 of the rotation body 80 meshes with the intermediate gear 65 as a result of the first rotational arm 84 being moved by the contacting arm 93*c* to the front side relatively with respect to the developer cartridge 28 when the developer cartridge 28 is attached to the main casing 2, so that in a state before attachment, the gear tooth portion 83 and the intermediate gear 65 are maintained in an unmeshed state unless a force is applied to the first rotational arm 84. Accordingly, at the time of testing before factory shipment, even when the respective gears 62 to 66 of the developer cartridge 28 are rotated, since the rotation body 80 never rotates with the respective gears 62 to 66, the first rotational arm 84 can be kept maintained at a regular position until the developer cartridge 28 is mounted on the main casing 2.

As a result of the protective wall 74 that encloses the second rotational arm 85 from the three rear, front, and left sides being formed at the rear end of the long groove 71, when the second rotational arm 85 is located at the rear end of the long groove 71, the protective wall 74 prevents an 25 external force from acting on the second rotational arm 85 from the three rear, front, and left sides. Therefore, for example, at the time of testing before factory shipment, the second rotational arm 85 is inhibited from being pressed by an operator or the like, and the second rotational arm 85 and the first rotational arm 84 can be reliably kept maintained at the regular positions. Moreover, since this protective wall 74 is formed at the obliquely lower rear side of the first rotational arm 84, the protective wall 74 also prevents an external force from acting on the first rotational arm 84 from the obliquely lower rear side. Therefore, for example, at the time of testing before factory shipment, the first rotational arm 84 is inhibited from being pressed by an operator or the like from the obliquely lower rear side, and the first rotational arm 84 can be reliably kept maintained at the regular position.

As a result of the protective wall 73 that encloses the respective rotational arms 84 and 85 from the three rear, front, and left sides being formed at the front end of the long groove 71, when the first rotational arm 84 is located at the front end of the long groove 71, the protective wall 73 prevents an external force from acting on the respective rotational arms 84 and 85 from the three rear, front, and left sides. Therefore, when, for example, the developer cartridge 28 in the middle of usage is removed from the main casing 2 (for example, the time of a paper jam or the like), even if a user intends to touch the respective rotational arms 84 and 85, since the protective wall 73 has made the respective rotational arms 84 and 85 difficult to touch, this can inhibit erroneous detection of a new product determination caused by a user's erroneous operation.

Here, the present invention can be used in various embodiments as exemplified in the following without being limited to the above embodiment.

In the above embodiment, the detecting arm 93 has been made so as to be swingable by supporting almost a central portion of the detecting arm 93 about an axis, however, the present invention is not limited hereto, and one end of the detecting arm may be supported about an axis, for example. Also, in this case, it is sufficient, for example, to arrange the other end of the detecting arm at a position where contact with the rotational arm is possible and arrange a part between one end and the other end of the detecting arm between the light emitting unit and the light receiving unit of the optical sensor.

In the above embodiment, the gear tooth portion 83 and the intermediate gear 65 have been meshed with each other by making the first rotational arm 84 contact with the detecting arm 93 when the developer cartridge 28 is attached to the main casing 2, however, the present invention is not limited hereto. That is, any object with which the first rotational arm 84 is made to contact is acceptable as long as it is a part of the main casing 2 (an element on the main casing 2 side). However, since setting the object with which the first rotational arm 84 is made to contact as the detecting arm 93 as in the present embodiment makes it possible to suppress the number of elements, such a manner as in the above embodiment is desirable.

In the above embodiment, one optical sensor 92 is provided at a position corresponding to the neutral position of the detecting arm 93. However, the number and position of optical sensor is not limited to this example. For example, a plurality of optical sensors may be disposed at different positions instead of the optical sensor 92.

As shown in FIGS. 7A and 8A, instead of the optical sensor 92, two optical sensors 921 and 922 may be disposed at positions across a position corresponding to the neutral position of the detection arm 93 from each other. The optical sensor 921 is disposed at a position corresponding to a position downstream of the neutral position with respect to the front side direction in FIGS. 7A to 8D (the first swing direction), and the optical sensor 922 is disposed at a position corresponding to a position downstream of the neutral position with respect to the rear side direction in FIGS. 7A to 8D (the second swing direction). The optical sensor 921 is shown only in FIGS. 7A, 7B, 8A and 8B and the optical sensor 922 is shown only in FIGS. 7A, 8A and 8C for simplification.

As shown in FIGS. 7A to 7D, when the controller 95 detects the turn OFF of the optical sensor 921 (FIG. 7B) and does not detect the turn OFF of the optical sensor 922 during the idle rotation operation, the controller 95 determines that the developer cartridge 28 is a new product and is of a type where the maximum sheets to be printed are 3000. On the other hand, as shown in FIGS. 8A to 8D, when the controller 95 detects the turn OFF of both the optical sensor 921 (FIG. 8B) and the optical sensor 922 (FIG. 8C) during the idle rotation operation, the controller 95 determines that the developer cartridge 28 is a new product and is of a type where the maximum sheets to be printed are 6000.

In the above embodiment, the optical sensor 92 has been employed as the detecting unit, however, the present invention is not limited hereto, and a distance sensor (an ultrasonic sensor, an optical sensor, or the like) or the like that detects the position of the front end of the detecting arm may be employed, for example. Moreover, a swing of the detecting arm can also be detected by providing a leaf spring so as to contact with the detecting arm and providing a strain gauge on this leaf spring.

In the above embodiment, the coil spring 94 has been employed as the elastic member, however, the present invention is not limited hereto, and a torsion spring or a leaf spring may be used.

In the above embodiment, the present invention has been applied to the laser printer 1, however, the present invention is not limited hereto, and the present invention may be applied to other image forming apparatuses such as, for example, copiers and multi function devices.

What is claimed is:

1. An image forming apparatus comprising:

a main unit; and a developer cartridge detachably attached to the main unit, wherein the developing cartridge comprises:

a rotation body having a rotational axis and rotatable in a rotation direction; and a first rotational arm and a second rotational arm which are rotatable around the rotational axis, and the main unit comprises:

a driving unit configured to rotate the rotation body in the rotation direction;

a detecting arm swingable from a neutral position toward a first swing direction and toward a second swing direction opposite to the first swing direction;

an elastic member that urges the detecting arm toward the neutral position;

a detecting unit configured to detect a swing of the detecting arm; and a controller configured to determine whether the developer cartridge is a new product according to the presence of a swing of the detecting arm detected by the detecting unit and determine a type of the developer cartridge according to a number of swings detected by the detecting unit, wherein, when the developer cartridge is attached to the main unit, the first rotational arm contacts with the detecting arm to swing in the first swing direction from the neutral position, wherein when the rotation body rotates by a predetermined rotation amount, the second rotational arm contacts with the detecting arm causing the detecting arm to swing in the second direction from the neutral position.

2. The image forming apparatus according to claim 1, wherein the detecting unit is configured to detect whether the detecting arm is positioned at one or more predetermined positions.

3. The image forming apparatus according to claim 2, wherein the detecting unit is configured to detect whether the detecting arm is positioned at the neutral position.

4. The image forming apparatus according to claim 3, wherein the detecting unit has a first state and a second state depending on the position of the detecting arm, the detecting unit becomes the first state when the detecting arm is positioned at the neutral position, and the detecting unit becomes the second state when the detecting arm is positioned at other positions than the neutral position, wherein, during a travel of the detecting arm from a position where the first rotational arm contacts with the detecting arm to a position where the second rotational arm contacts with the detecting arm, the detecting unit becomes the first state once.

5. The image forming apparatus according to claim 2, wherein the detecting unit is configured to detect whether the detecting arm is positioned at a first detection position and a second detection position, the first detection position positioned downstream of the neutral position with respect to the first swing direction, and the second detection position positioned downstream of the neutral position with respect to the second swing direction.

6. The image forming apparatus according to claim 1, wherein the second rotational arm is positioned upstream of the first rotational arm in the rotation direction.

7. The image forming apparatus according to claim 6, wherein an upstream side of the first rotational arm in the rotation direction contacts with the detecting arm.

8. The image forming apparatus according to claim 6, wherein a downstream side of the second rotational arm in the rotation direction contacts with the detecting arm.

9. The image forming apparatus according to claim 1, wherein the rotation body is rotatable from a first rotation position to a third rotation position via a second rotation position in the rotation direction, wherein the first rotational arm contacts with the detecting arm when the rotation body is positioned upstream of the second rotation position in the rotation direction, wherein the first rotational arm is separated from the detecting arm and the second rotational arm contacts with the detecting arm when the rotation body is positioned between the second rotation position and the third rotation position, and wherein the second rotational arm is separated from the detecting arm when the rotation body is positioned at the third rotation position.

10. The image forming apparatus according to claim 9, further comprising a transmission gear configured to transmit a driving force from the driving unit to the rotation body, wherein the rotation body comprises a rotational gear formed on a part of a circumference of the rotation body and configured to mesh with the transmission gear.

11. The image forming apparatus according to claim 10, wherein the rotational gear is unmeshed with the transmission gear when the rotation body is positioned at the first rotation position.

12. The image forming apparatus according to claim 11, wherein, during an attaching operation of the developer cartridge to the image forming apparatus, a part of the main unit contacts with the first rotational arm and applies a force to the first rotational arm to cause the rotation body to move from the first rotation position to a fourth rotation position that is upstream of the second rotation position, wherein, when a rotation position of the rotation body is changed from the first rotation position to the fourth rotation position, the rotational gear is meshed with the transmission gear.

13. The image forming apparatus according to claim 12, wherein when the rotation position of the rotation body is changed to a position between the fourth rotation position and the third rotation position, a mesh of the rotational gear with the transmission gear is released.

14. The image forming apparatus according to claim 1, wherein the rotation body is rotatable 360 degrees or less in the rotation direction.

15. The image forming apparatus according to claim 1, wherein the rotation body begins to rotate substantially at a time of beginning of a drive of the main unit.

* * * * *